US006568466B2

(12) United States Patent
Lowenstein et al.

(10) Patent No.: US 6,568,466 B2
(45) Date of Patent: May 27, 2003

(54) HEAT EXCHANGE ASSEMBLY

(76) Inventors: Andrew Lowenstein, 18 Cameron Ct., Princeton, NJ (US) 08540; Marc Sibilia, 217 Washington Rd., Princeton, NJ (US) 08540; Jeffrey Miller, 4 Park Ave., Rocky Hill, NJ (US) 08553; Thomas S. Tonon, 35 Birch Ave., Princeton, NJ (US) 08542

( * ) Notice: Subject to any disclaimer, the term of this patent is extended or adjusted under 35 U.S.C. 154(b) by 0 days.

(21) Appl. No.: 09/887,453

(22) Filed: Jun. 22, 2001

(65) Prior Publication Data

US 2002/0023740 A1 Feb. 28, 2002

Related U.S. Application Data

(60) Provisional application No. 60/213,619, filed on Jun. 23, 2000.

(51) Int. Cl.[7] ..... F28D 1/03

(52) U.S. Cl. ..... 165/153; 165/167; 165/176

(58) Field of Search ..... 165/153, 166, 165/167, 173, 175, 176

(56) References Cited

U.S. PATENT DOCUMENTS

| | | | |
|---|---|---|---|
| 3,262,496 | A | 7/1966 | Bawabe |
| 3,731,736 | A | 5/1973 | Fernandes |
| 4,898,153 | A | 2/1990 | Sherwood |
| 4,969,507 | A | 11/1990 | Rosenblad |
| 5,351,497 | A | 10/1994 | Lowenstein |
| 5,469,915 | A | 11/1995 | Cesaroni |
| 5,638,900 | A | 6/1997 | Lowenstein et al. |
| 6,079,481 | A | 6/2000 | Lowenstein et al. |
| 6,170,567 | B1 * | 1/2001 | Nakada et al. ..... 165/153 |

FOREIGN PATENT DOCUMENTS

| | | |
|---|---|---|
| DE | 42 37 672 A1 | 5/1994 |

* cited by examiner

*Primary Examiner*—Allen Flanigan
(74) *Attorney, Agent, or Firm*—Watov & Kipnes, P.C.

(57) ABSTRACT

A heat exchange assembly comprises a plurality of plates disposed in a spaced-apart arrangement, each of the plurality of plates includes a plurality of passages extending internally from a first end to a second end for directing flow of a heat transfer fluid in a first plane, a plurality of first end-piece members equaling the number of plates and a plurality of second end-piece members also equaling the number of plates, each of the first and second end-piece members including a recessed region adapted to fluidly connect and couple with the first and second ends of the plate, respectively, and further adapted to be affixed to respective adjacent first and second end-piece members in a stacked formation, and each of the first and second end-piece members further including at least one cavity for enabling entry of the heat transfer fluid into the plate, exit of the heat transfer fluid from the plate, or 180° turning of the fluid within the plate to create a serpentine-like fluid flow path between points of entry and exit of the fluid, and at least two fluid conduits extending through the stacked plurality of first and second end-piece members for providing first fluid connections between the parallel fluid entry points of adjacent plates and a fluid supply inlet, and second fluid connections between the parallel fluid exit points of adjacent plates and a fluid discharge outlet so that the heat transfer fluid travels in parallel paths through each respective plate.

3 Claims, 16 Drawing Sheets

HEAT EXCHANGE ASSEMBLY

This application claims the benefit of Provisional application Ser. No. 60/213,619, filed Jun. 23, 2000.

FIELD OF THE INVENTION

The present invention relates to a heat exchange assembly, and more particularly to a plate heat exchange assembly which may be optionally utilized as a liquid-to-gas heat exchanger, a low-flow internally-cooled liquid-desiccant absorber, a liquid-desiccant regenerator or an evaporatively-cooled fluid cooler.

BACKGROUND OF THE INVENTION

Heating, ventilating, and air conditioning (HVAC) systems regulate ambient conditions within buildings for comfort. Such systems provide control of the indoor environment in a given space to create and maintain desirable temperature, humidity, and air circulation, for the occupants. One important component found in such systems is a heat exchanger which is a device used for transferring heat from one medium to another without allowing the media to mix.

One type of heat exchanger comprises a plurality of plates arranged in a spaced apart relationship by spacers. The space between adjacent plates provides a flow path for a heat transfer fluid. Each of the plates comprises a double walled board of metal or plastic, the walls being spaced-apart by partitions that form a plurality of internal passages therein. The partitions defining the internal passages provide a fluid flow path for a second heat transfer fluid. Examples of the use of such heat exchangers and details of their construction and operation are disclosed in U.S. Pat. No. 5,638,900 and U.S. Pat. No. 6,079,481, each of which is incorporated herein by reference.

U.S. Pat. No. 5,469,915 discloses a heat exchanger comprising a plurality of plates (also referred as "panels) arranged in a spaced apart manner. Each plate comprises a plurality of open-ended tubular members oriented in a planar arrangement sandwiched between a pair of thin, plastic films laminated thereon. A manifold is mounted to each open end of the plates. A heat transfer fluid is supplied to the plates from one manifold and exits the plates through the other manifold. In one embodiment, each manifold has multiple orifices into which the ends of the plate's tubes are inserted and sealed. In another embodiment, each manifold is composed of two pieces, each piece with semicircular recesses that match the contour of the tubes. The ends of the plate's tubes are clamped between the two halves of the manifold so that the ends of the plate's tubes are completely contained within the manifold and the manifold and plate form a leak-tight assembly. For either embodiment of the manifold, a heat exchanger assembly composed of two or more plates can be made by stacking and joining together the manifolds.

U.S. Pat. No. 4,898,153 discloses a solar heat exchanger constructed from a double-walled plate with multiple internal flow passages. It is further disclosed that the ends of the plate are coupled to end components which provide recesses for turning a fluid flowing through the plates 180° and outlet and inlet fittings are attached to the end components.

In an HVAC system, a dehumidifier may be used to extract moisture from the process air to yield relatively dry air. The air to be processed is usually dehumidified by cooling and/or by dehydration. In a dehydration process, air is usually passed through a device referred to as an absorber which typically includes chambers containing an absorptive material such as, for example, silica gel or calcium chloride.

One type of absorber referred to herein as a liquid-desiccant absorber, utilizes a liquid desiccant, or drying agent, to remove water vapor from the air being processed. An example of a liquid-desiccant absorber and further details of its operation are disclosed in U.S. Pat. No. 5,351,497, incorporated herein by reference.

Liquid-desiccant absorbers typically include a porous bed of a contact medium saturated with a liquid desiccant. As the desiccant flows and permeates throughout the bed, it comes into contact with the water-containing air flowing therethrough. The desiccant, which by definition, has a strong affinity for water vapor, absorbs or extracts the moisture from the process air.

During the dehumidification process, heat is generally released as the water vapor condenses and mixes with the desiccant. The total amount of heat generated usually equals the latent heat of condensation for water plus the heat generated by mixing the desiccant and water. In a typical absorber, the heat of mixing will be about an order of magnitude smaller than the latent heat of condensation. The heat released during dehumidification raises the temperature of the air and desiccant. The air exits the absorber with approximately the same enthalpy as when it entered. For example, air enters the absorber at 80° F., 50% relative humidity (31.3 BTU/lb enthalpy) and leaves at 97° F., 20% relative humidity (31.5 BTU/lb enthalpy). In this configuration, the absorber functions strictly as a dehumidifier.

The absorber may be incorporated into an air-cooling system. By cooling the desiccant and the process air through a heat exchanger utilizing a coolant or refrigerant, the process air exits the absorber at a lower enthalpy and relative humidity than when it entered, thus generating a desirable net cooling effect. Absorbers utilizing such coolant assemblies often exhibit increased dehumidification capacity and efficiency over those that do not. However, prior art internally-cooled absorbers are typically more difficult and expensive to fabricate. In addition, such absorbers often experience difficulties in keeping the respective heat exchanging fluid streams and liquid desiccant separate and apart due to persistent leakage problems.

It would therefore be a significant advance in the art of heat exchangers to provide a heat exchange assembly which can effectively maintain the respective heat transfer fluids or media separate from one another and which can be constructed effectively from corrosion-resistant materials in a configuration that may be utilized in a wide variety of heat transfer systems, including, but not limited to, liquid-to-gas heat exchangers, internally-cooled liquid-desiccant absorbers, and evaporatively-cooled fluid coolers.

SUMMARY OF THE INVENTION

The present invention is generally directed to a heat exchange assembly which comprises:

- a plurality of plates disposed in a spaced-apart arrangement, each of the plurality of plates includes a plurality of passages extending internally from a first end to a second end for directing flow of a heat transfer fluid in a first plane;
- a plurality of first end-piece members equaling the number of plates and a plurality of second end-piece members also equaling the number of plates, each of the first and second end-piece members including a recessed region adapted to fluidly connect and couple with the first and second ends of the plate, respectively, and further adapted to be affixed to respective adjacent first and second end-piece members in a stacked formation, and each of the first and second end-piece members further including at least one cavity for enabling entry of the heat transfer fluid into the plate, exit of the heat transfer fluid from the plate, or 180° turning of the fluid within the plate to create a fluid flow path between points of entry and exit of the fluid; and at least two fluid conduits extending through the stacked plurality of first and second end-piece members for providing first fluid connections between the parallel fluid entry points of adjacent plates and a fluid supply inlet, and second fluid connections between the parallel fluid exit points of adjacent plates and a fluid discharge outlet so that the heat transfer fluid travels in parallel paths through each respective plate.

In another aspect of the present invention, there is also provided a heat exchange assembly which comprises:

a plurality of plates disposed in a spaced-apart arrangement, each of the plurality of plates includes a plurality of passages extending internally from a first end to a second end for directing flow of a heat transfer fluid in a first plane;

a plurality of end-piece members equaling the number of the plates, each of the end-piece members includes a recessed region adapted to fluidly connect and couple with the first end of the plate, and further adapted to be affixed to respective adjacent end-piece members in a stacked formation, and further including at least one cavity for enabling entry of the heat transfer fluid into the plate, exit of the heat transfer fluid from the plate, or 180° turning of the fluid within the plate to create a fluid flow path between points of entry and exit of the fluid;

fluid turning means at the first end of the plates for turning the flow of fluid into the plates; and a fluid supply inlet and a fluid discharge outlet each associated with the affixed end-piece members so that the heat transfer fluid travels in parallel paths through each respective plate.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

Figure 1:
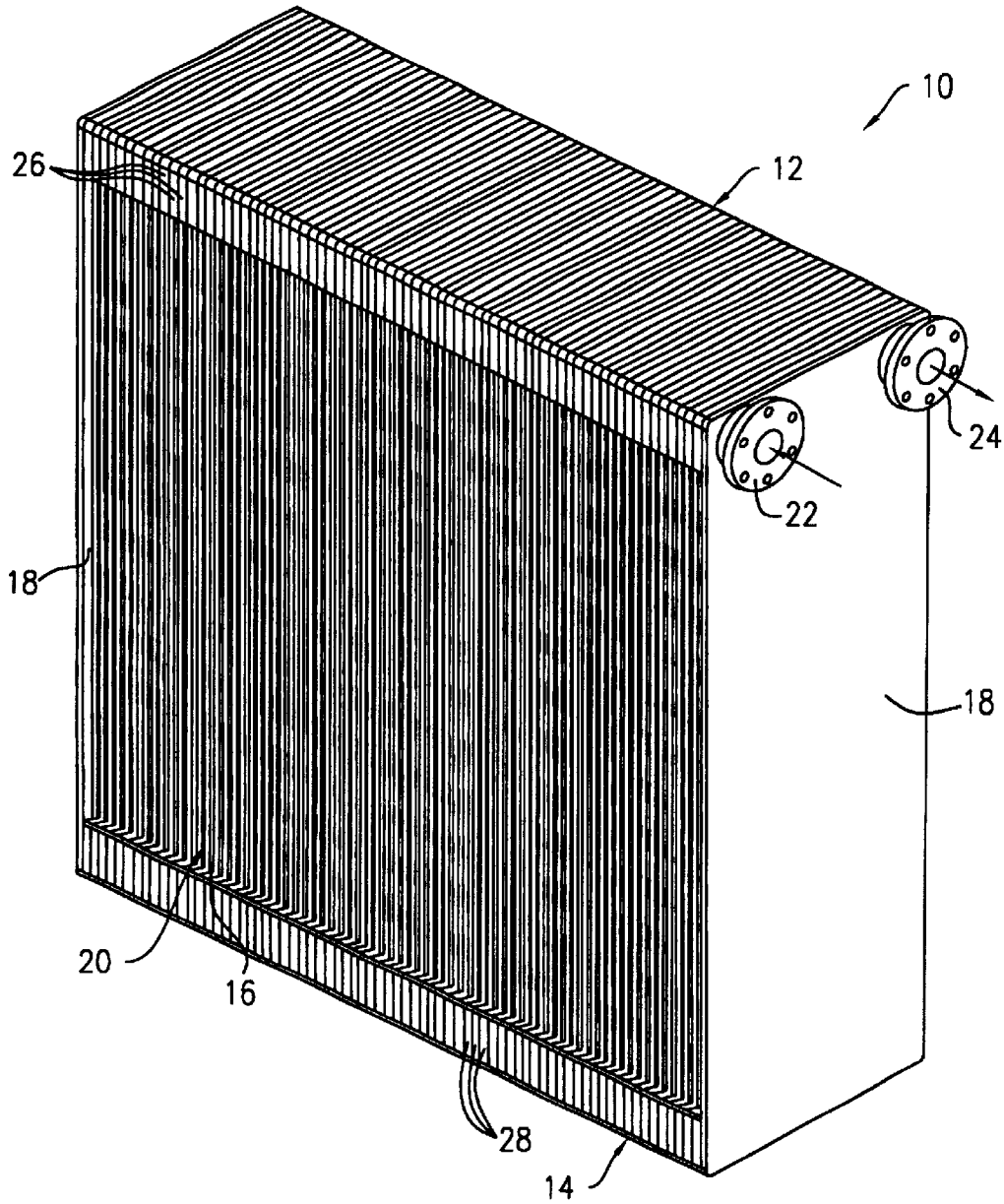
FIG. 1 is a perspective view of an embodiment of a heat exchange assembly in accordance with the present invention.

The present invention is generally directed to a heat exchange assembly constructed in a manner for efficiently and effectively transferring thermal energy between an isolated first fluid flowing through a plurality of spaced apart plates via a fluid manifold coupled at each end of the plurality of plates, and second and/or third fluids passing through the space between adjacent plates. The heat exchange assembly is constructed from a light-weight material and adapted to provide reliable and efficient heat transfer. Optionally, the heat exchange assembly may be configured to operate as an internally-cooled liquid-desiccant absorber for regulating the water content of a fluid flowing over the surface of the liquid desiccant, a liquid-desiccant regenerator adapted for expelling moisture in the liquid desiccant to an air stream passing over the surface of the liquid desiccant, or an evaporatively-cooled fluid cooler for removing heat from the fluid flowing internally within the plates.

In contrast to the heat exchangers that are described in U.S. Pat. No. 5,469,915, the ends of the plates do not have to be inserted into openings in the manifolds, yet there is still only one manifold piece attached to each end of the plate. In contrast to the solar heat exchanger described in U.S. Pat. No. 4,898,153, the manifold pieces also function as spacers that provide the desired gap between plates.

The heat exchange assembly provides generally for a heat transfer fluid flowing through a plurality of plates, each plate having first and second ends, and one or more internal passages extending between the first and second ends. An end-piece member is fluidly coupled to each end of the plate for directing fluid flow within the passages of the plate. The plates isolate the heat transfer fluid from the external fluid medium, while maintaining a heat exchange relationship therebetween. The plate forming the passages therein are preferably made from profile board or similar materials, corrugated board, tube sheets, stamped sheets, thermoformed sheets, and the like, each of which can be easily constructed from rigid corrosion-resistant materials such as plastic polymer material, corrosion-resistant metal, and the like.

As used herein, the term "profile board" shall mean an assembly constructed as a double walled sheet, wherein the walls are separated by a series of ribs or webs, preferably uniformly spaced, along the full length of the sheet. The ribs define the plurality of passages referred to herein. An example of the construction of a profile board is disclosed in U.S. Pat. No. 4,898,153, the content of which is incorporated herein by reference.

As used herein, the term "corrugated board" shall mean an assembly generally comprising three thin plates, two of which are essentially flat and form the outer surfaces of the board, and a third plate which is not flat. The third plate is typically folded, molded, stamped or otherwise formed so that when it is inserted between the first two plates, it maintains the outer plates parallel to each other while forming flow passages therebetween that run the length of the board. The three thin plates can be glued, bonded, welded, fastened or fused together at their points of contact to form a more rigid structure.

As used herein the term "tube sheet" shall mean an assembly constructed from multiple open-ended tubular members, each with a circular cross section, that are joined along their length to form a substantially planar structure.

Referring to the drawings and particularly to FIG. 1, a heat exchange assembly 10 of the present invention is shown. The heat exchange assembly 10 comprises generally a top fluid manifold 12, a bottom fluid manifold 14, a plurality of hollow, rectilinear plates 16 arranged in a parallel, spaced-apart relationship, and a pair of side panels 18 for enclosing the ends thereof. The top fluid manifold 12 is composed of a plurality of top end-piece members 26 with adjacent members juxtaposed in abutting engagement. The bottom fluid manifold 14 is composed of a plurality of bottom end-piece members 28 arranged in a similar manner as described above for the top end-piece members 26. Each individual plate 16 is coupled to the top end-piece member 26 at one end 44 and the bottom end-piece member 28 at the other end 50 to form a plate and end-piece member component. In this configuration, each of the plate and end-piece member components is disposed in a stacked arrangement and securely affixed to one another. Each end-piece member 28 includes throughholes which forms the corresponding fluid-tight conduits and reservoirs. The components of the assembly 10 may be affixed by means including, but not limited to, gluing, welding, brazing, bonding, fusing, fastening, clamping, and the like to construct the heat exchange assembly 10. The assembly 10 further includes an inlet fitting 22 and an outlet fitting 24 fluidly coupled to the top fluid manifold 12.

The assembly 10 is adapted to receive an internal heat transfer fluid through the inlet fitting 22. The heat transfer fluid circulates through the assembly 10 whereby a heat exchange operation is carried out as will be described in detail hereinafter. In combination, the top and bottom fluid manifolds 12 and 14 and plates 16 are adapted to maintain a continuous flow path for the internal heat transfer fluid traveling through the assembly 10. The circulated internal heat transfer fluid is then discharged from the assembly 10 through the outlet fitting 24. It is noted that the assembly 10 may be modified to provide multiple inlet and/or outlet fittings and to provide such inlet or outlet fitting at other locations as desired.

The spaced-apart plates 16 define a plurality of spacings 20 adapted to permit the stationary presence or passage therethrough of a external solid or fluid medium. In the latter, a fluid medium passes through the spacings 20 of the assembly 10 at one end and exit out at the opposite end. The spacings 20 between the adjacent plates 16 are preferably uniform and equally spaced apart, while being relatively close together for facilitating an efficient and compact heat exchange operation. The plates 16 of the assembly 10 are generally arranged in a vertical orientation. However, it is understood that the plates 16 may also be arranged in other suitable orientations depending on the application or requirements.

The internal heat transfer fluid flowing in the passages may be in the form of a liquid or a gas. The external medium may be in the form of a solid, a liquid or a gas. For example, a solid may be an apparatus that is capable of exchanging heat with the internal heat transfer fluid. The present heat exchange assembly may be used in, for example, ice storage systems, evaporative fluid coolers, liquid desiccant absorbers, liquid desiccant regenerators, vapor condensers, liquid boilers, liquid-to-gas heat exchangers, or any applications where the transfer of heat between discrete mediums is desired.

Figure 2:
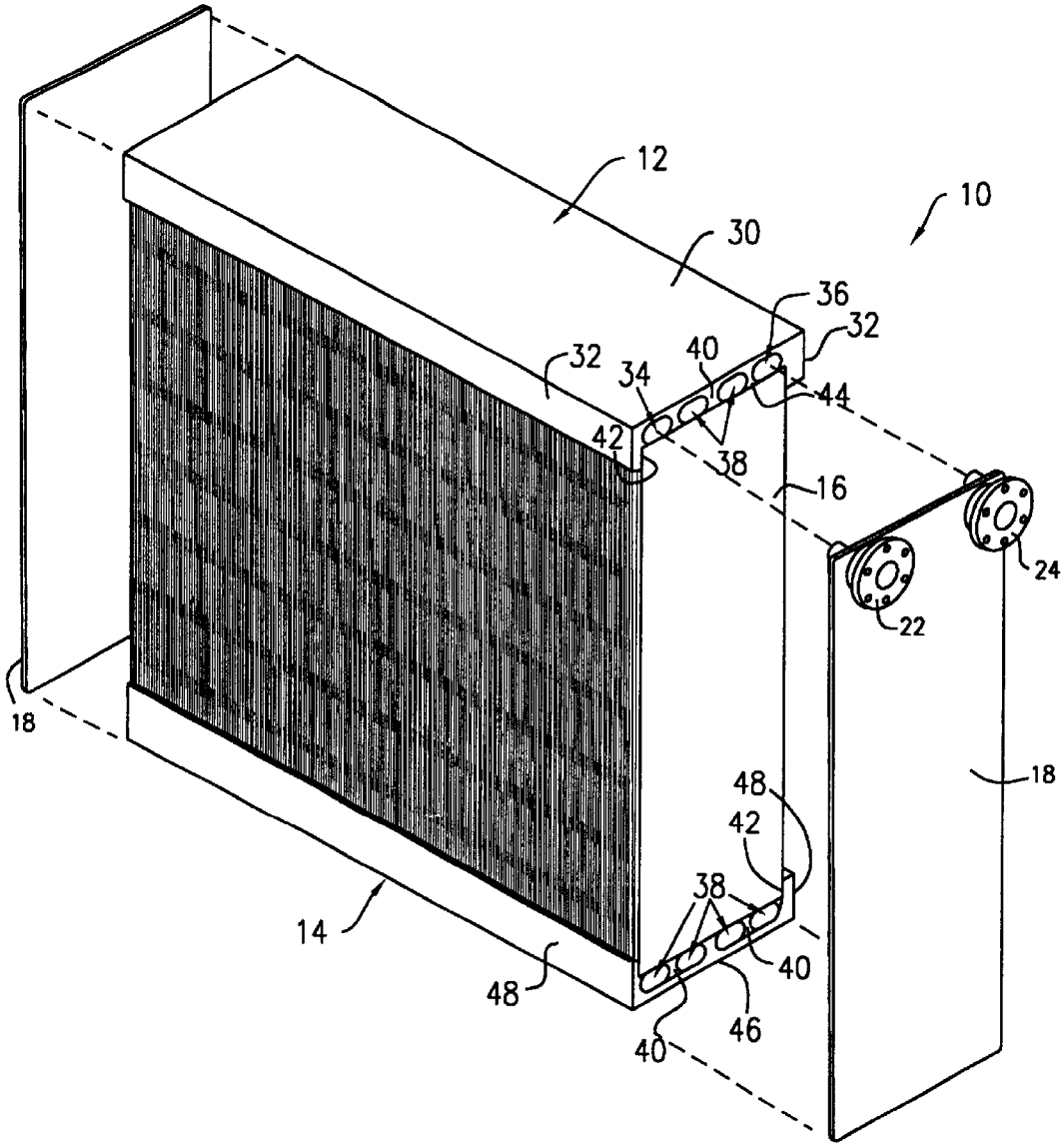
FIG. 2 is a partial exploded assembly view of the heat exchange assembly of FIG. 1.
Figure 3:
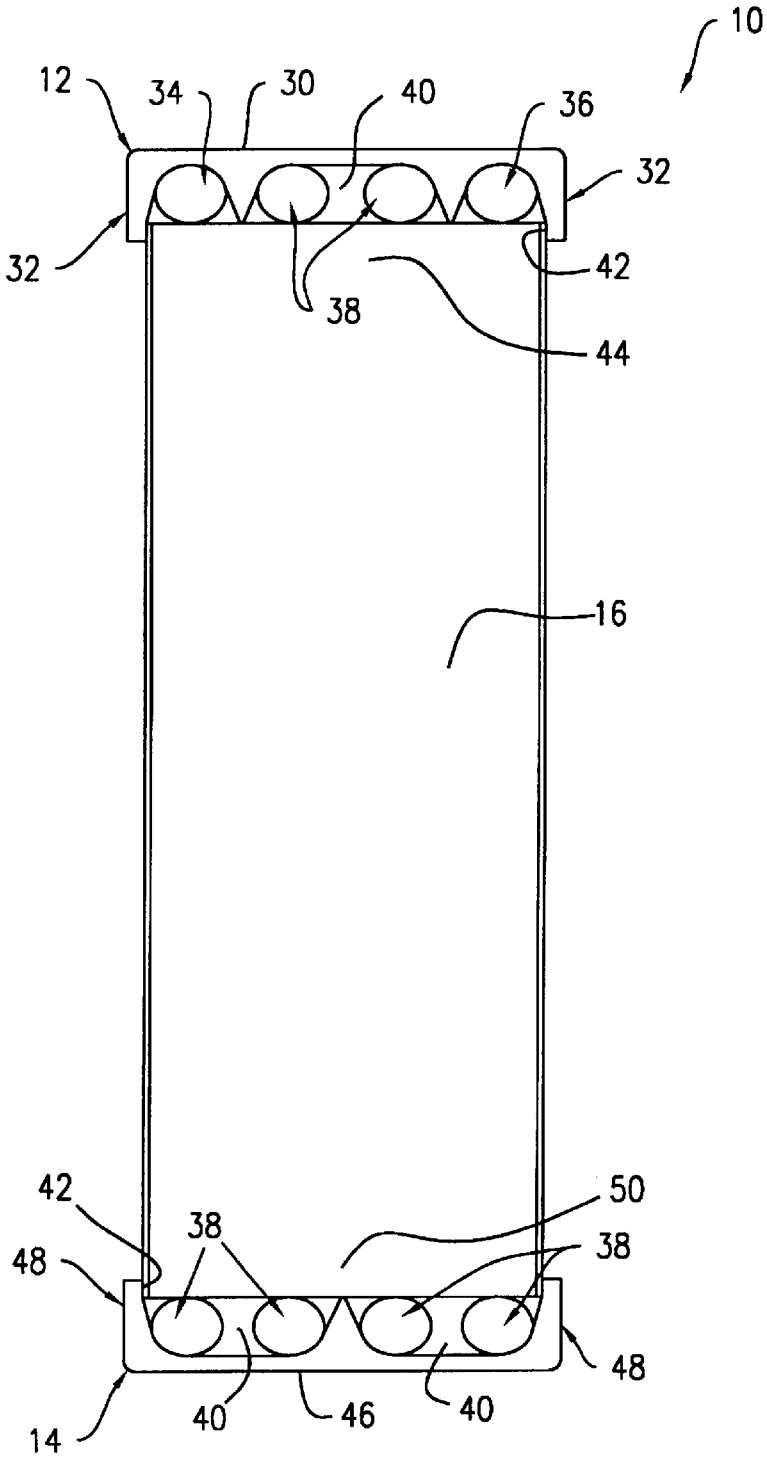
FIG. 3 is an elevational view of a top fluid manifold, a bottom fluid manifold and a plate mounted therebetween according to the present invention.

Referring to FIGS. 2 and 3, the top fluid manifold 12 and bottom fluid manifold 14 are each configured, in combination, to securely retain the plurality of plates 16 in a spaced-apart relationship, facilitate fluid flow into and out of the plurality of plates 16 and establish a fluid flow path (e.g. a serpentine-line fluid flow path) within each plate 16 as will be described in detail hereinafter. In particular, the manifolds 12 and 14 comprise structural features aligned with each of the plates 16 to facilitate the desired flow of the fluids within and around the plates 16. The fluid flow path (e.g. serpentine-like fluid flow path) permits the internal heat transfer fluid to pass through a corresponding plate 16 a multiple number of times, thereby maximizing the heat exchange operation between the associated mediums. The side panels 18 are each affixed to the end of the assembly 10 for sealing or enclosing the internal heat transfer fluid in the respective internal volumes, and for providing the assembly 10 with structural strength and rigidity.

The top fluid manifold 12 includes an end wall 30 and a pair of side walls 32 extending longitudinally along the edge of the end wall 30. The top fluid manifold 12 when in operative position securing a plurality of plates 16 together defines an inlet conduit 34, and an outlet conduit 36, each extending internally along the length thereof. The inlet conduit 34 is in fluid communication with the inlet fitting 22 and conveys the internal heat transfer fluid to each of the plurality of plates 16 along the length of the assembly 10. The internal heat transfer fluid flows to and from the bottom fluid manifold 14 along its path within each plate 16 until it reaches the outlet conduit 36 and discharges out through the outlet fitting 24. The top fluid manifold 12 at the position of each plate 16, further includes one or more turning cavities 40 and a recessed region 42 aligned with each plate 16. The turning cavity 40 serves to direct fluid flowing out of the plate 16 and return it back into the plate 16 for a continuous flow as will be described in detail. The recessed region 42 is adapted to receive and securely retain an end portion 44 of the corresponding plate 16 for a fluid-tight seal fit therebetween.

Optionally, the top fluid manifold 12 includes a, optional bypass conduit 38 which extends longitudinally through the turning cavity 40 associated with each plate 16. The bypass conduit 38 provides open fluid communication between adjacent turning cavities 40. The bypass conduit 38 permits the internal heat exchange fluid to bypass a plate 16 if one or more passages 54 in the plate 16 are blocked or obstructed. During normal operation, little or no fluid is exchanged between the plates 16 at the fluidly connected turning cavities 40. However, when one or more passages 54 are blocked or obstructed in a plate 16, the corresponding fluid may circumvent the blockage by traversing a bypass conduit 38 to thereby flow into an adjacent unobstructed plate 16.

The bottom fluid manifold 14 is structurally similar to the top fluid manifold 12. The bottom fluid manifold 14 includes an end wall 46, and a pair of side walls 48 extending longitudinally along the edge of the end wall 46. The bottom fluid manifold at the position of each plate, further 14 includes one or more turning cavities 40 and a recessed region 42 aligned with each plate. The turning cavity 40 serves to direct fluid flowing out of the plate 16 and return it back into the plate 16 for a continuous flow thereof. The recessed region 42 is adapted to receive and securely retain an end portion 50 of the corresponding plate 16 for a fluid tight seal. The bottom fluid manifold 14 may optionally include one or more bypass conduits 38 with each bypass conduit 38 aligned with an individual plate 16. The arrangement of plates 16 and the manifolds securing the same enable the bypass conduits 38 to extend along the length of the assembly 10 and provide fluid communication between the turning cavities 40 associated with the individual plates that are longitudinally aligned with one another in the assembly 10. The function of the bypass conduits 38 in the bottom fluid manifold 14 is the same as described above for the top fluid manifold 12.

Figure 4:
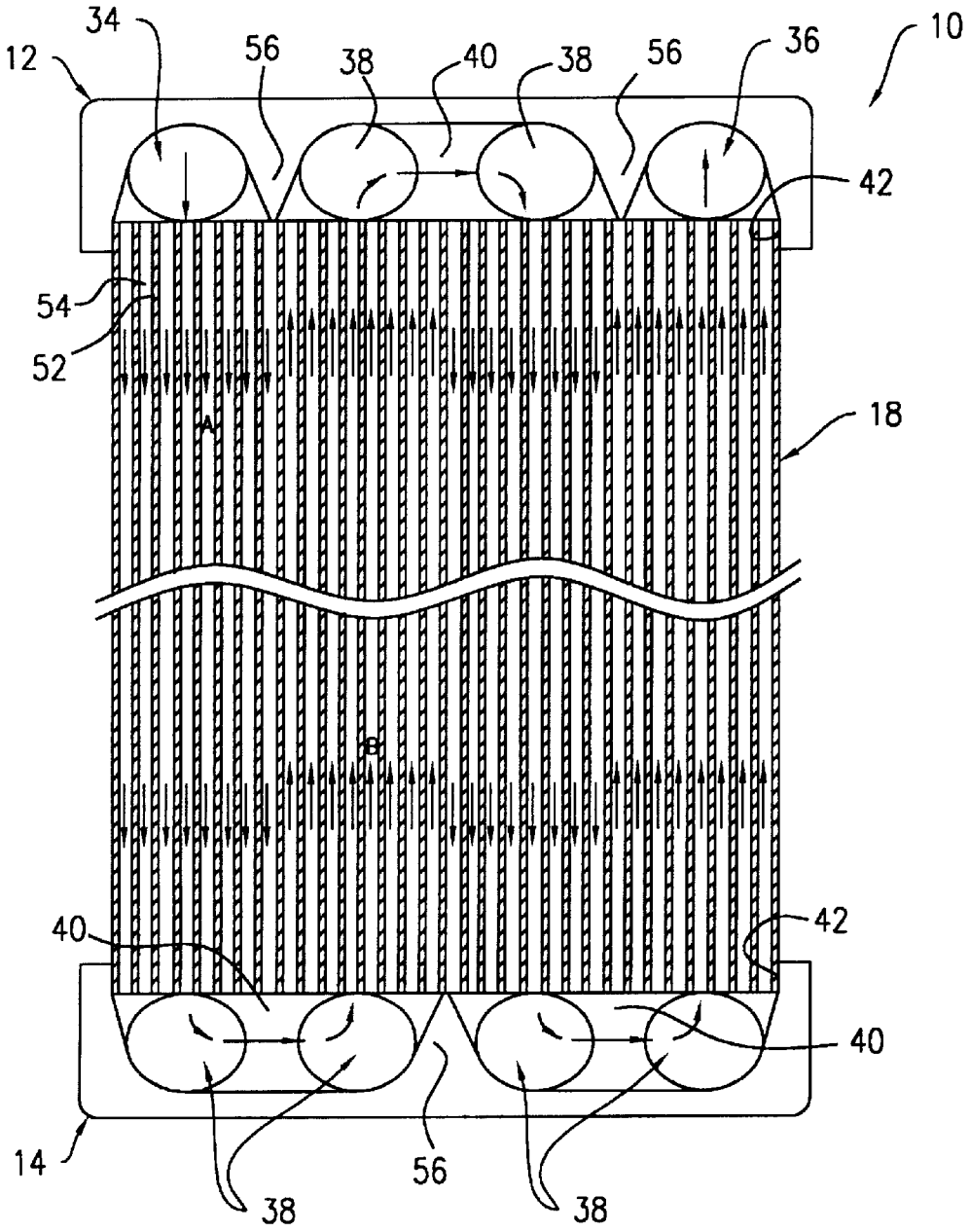
FIG. 4 is a partial cross sectional view of the heat exchange assembly showing the flow path of the internal heat transfer fluid through the manifolds and plate according to the present invention.

Referring to FIG. 4, the flow path of the internal heat transfer fluid through the top and bottom fluid manifolds 12 and 14, respectively, and the plate 16 is illustrated in detail. The plate 16 comprises a plurality of spaced apart walls 52 defining a plurality of open-ended passages 54 for conveying a fluid. The top and bottom fluid manifolds 12 and 14, respectively, include one or more barriers 56 for enclosing the respective conduits, turning cavities and passages associated with the individual plates 16 to facilitate an orderly fluid flow. Fluid tends to flow in the direction from a region of high pressure (i.e. inlet conduit 34) to a region of low pressure (i.e. outlet conduit 36). The internal heat transfer fluid first enters the inlet conduit 34 via the inlet fitting 22 and flows through at least one passage 54 in the direction of arrows "A" towards the bottom fluid manifold 14. The fluid enters the turning cavity 40 which directs the flow 180° back into the plate 16 in the direction of arrows "B" towards the top fluid manifold 12. The fluid turns two more times before entering the outlet conduit 36 and out of the assembly through the outlet fitting 24. The internal heat transfer fluid flows through each plate 16 of the assembly 10 in a parallel manner. During operation, it is preferable for the external fluid medium to flow in the direction opposite to the general flow of the internal heat transfer fluid in the plate 16.

As previously indicated the manifolds 12 and 14 define turning cavities 40 which direct the fluid flow back and forth through the plate 16. The number of turning cavities 40 provided may vary according to the needs and requirements of the assembly 10.

During a cooling operation, the internal heat transfer fluid is at the outset cooled by a cooling system (not shown) to a temperature lower than that of the external fluid medium (e.g. room air). The cooled internal heat transfer fluid then flows into the heat exchange assembly 10 via inlet fitting 22 (see FIG. 2) to the inlet conduit 34 into the plates 16. The internal heat transfer fluid travels along the serpentine-like fluid flow path turning 180° at each turning cavity 40. Since the internal heat transfer fluid is colder than the external fluid medium passing through the spacing 20 between the adjacent plates 16, heat is transferred from the external fluid medium through the walls of the plates 16 to the internal heat transfer fluid. The external fluid medium depleted of its thermal energy exits the heat exchange assembly 10 and is returned to a receiving area (e.g. room). The internal heat transfer fluid after passing through the plates 16 enters the outlet conduit 36 and leaves the heat exchange assembly 10 via the outlet fitting 24. The operation of the heat exchange assembly 10 during heating is similar, but with the obvious changes in the thermal transfer relationship between the internal heat transfer fluid and the external fluid medium.

Figure 5C:
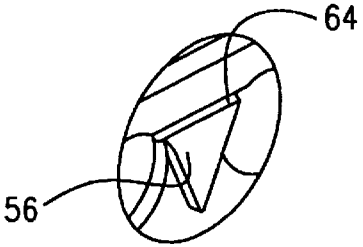
FIG. 5C is a exploded detailed view of a barrier of the top or bottom end-piece member modified for a second embodiment of the present invention.
Figure 5A:
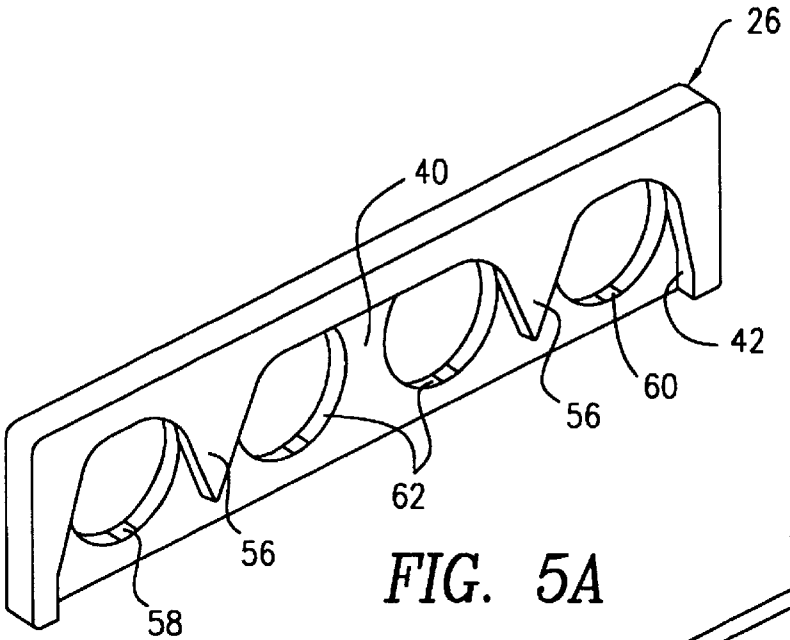
FIG. 5A is a perspective view of a top end-piece member of the heat exchange assembly according to the present invention.
Figure 5B:
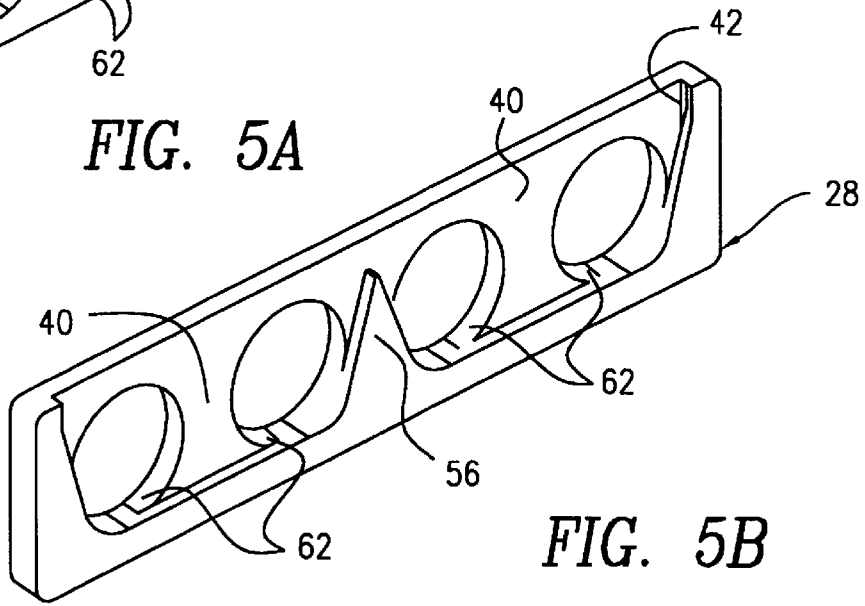
FIG. 5B is a perspective view of a bottom end-piece member of the heat exchange assembly according to the present invention.

Referring to FIGS. 5A and 5B, the top and bottom end-piece members 26 and 28, respectively, as described in connection with FIG. 1 are shown in greater detail. The top end-piece member 26 comprises the turning cavity 40, an inlet thoughhole 58 which forms a portion of the inlet conduit 34 of the top fluid manifold 12, an outlet throughhole 60 which forms a portion of the outlet conduit 36 of the top fluid manifold 12, and two bypass throughholes 62 which forms a portion of the bypass conduits 38. The top end-piece member 26 includes the recessed region 42 adapted to receive and securely retain the end portion 44 of the corresponding plate 16 for a fluid-tight seal fit therebetween. The edge of the plate 16 abuts against the tip of the barrier 56 to ensure the partitioning of the passages 54 for smooth fluid flow.

The bottom end-piece member 28 is shown in specifically in FIG. 5B. The bottom end-piece member 28 comprises two turning cavities 40, and four bypass throughholes 62 each of which forms a portion of the corresponding bypass conduits 38. It will be understood that the bottom end-piece member 28 may be configured to include the inlet throughholes 58 and/or the outlet throughholes 60 where it is desirable to have the inlet fittings 22 and/or outlet fittings 24, respectively, located at the bottom fluid manifold 14.

The bottom end-piece member 28 further includes the recessed region 42 adapted to receive and securely retain the end portion 50 of the corresponding plate 16 for a fluid-tight seal fit therebetween. The edge of the plate 16 abuts against the tip of the barrier 56 to ensure the partitioning of the passages 54 for smooth fluid flow. It is noted that the plate 16 may be securely affixed to recessed regions 42 of the end-piece members 26 and 28 by means including, but not limited to, gluing, welding, fusing, bonding, fastening, clamping and the like.

The number of turning cavities 40 in the end-piece members 26 and 28, respectively, may vary according to the requirements of the assembly 10. In the present embodiment, it is noted that the internal heat transfer fluid makes three 180° turns along its path through the plate 16 (as shown in FIG. 4). This configuration is referred to as a four-pass heat exchanger noting that the serpentine-like fluid flow path followed by the internal heat transfer fluid includes four straight sections. The turning cavities 40 are partitioned from one another and from the inlet and outlet throughholes 58 and 60, respectively, if present, by the barriers 56. The barriers prevent the internal heat transfer fluid from circumventing around the plate 16. Preferably, each turning cavity 40 includes a depth of about equal or greater than the thickness of the plate 16 or the passages 54 in the plate 16 for maximizing an unobstructed flow into or out of the corresponding plates 16.

The bypass throughholes 62 may optionally be included in the end-piece members 26 and 28, respectively, and are not critical to the operation of the assembly 10. The bypass throughholes 62 form the bypass conduits 38 in the assembly 10. The bypass conduits 38 are adapted for allowing the internal heat transfer fluid flowing in one plate 16 to flow into a parallel one should it encounter one or more blocked passages 54 as described above.

The overall thickness of each individual end-piece member 26 or 28 typically includes the thickness of the affixed plate 16 and the desired spacing width between adjacent plates 16. Preferably, the depth of the recessed regions 42 in the top and bottom end-piece members 26 and 28 equals the thickness of the plate 16. However, it is noted that the depth of the recessed region may vary relative to the thickness of the plate 16, and may be less than the plate thickness. In the latter, the opposite side of the end-piece member 26 or 28 may further include a corresponding recessed region for receiving the extended and exposed portion of the plate 16. Similarly, the depth of the recessed region 42 may be greater than the thickness of the plates 16. Therefore, the opposite side of the end-piece member 26 or 28 includes a raised area adapted for a snug fit into the recessed region 42 of the adjacent end-piece member 26 or 28, respectively, against the plate 16 occupying the recessed region 42. In this manner, the plate 16 of the adjacent end-piece member 26 or 28 is securely retained therebetween.

Referring to FIG. 5C, the barriers 56 in the top and bottom end-piece members 26 and 28 may be modified to include a bypass channel 64 for a second embodiment of the present invention. The bypass channel 64 fluidly connects the turning cavities, reservoirs and the conduits, and facilitates the draining of the assembly 10 during maintenance/repair or the purging of trapped air or gases during the filling of the internal heat transfer fluid into the assembly 10. The bypass channel 64 is dimensioned in a manner that the flow rate through the plate 16 is not appreciably affected by the bypass channels 64, preferably less than 3% of the total flow rate of the internal heat transfer fluid.

Figure 6:
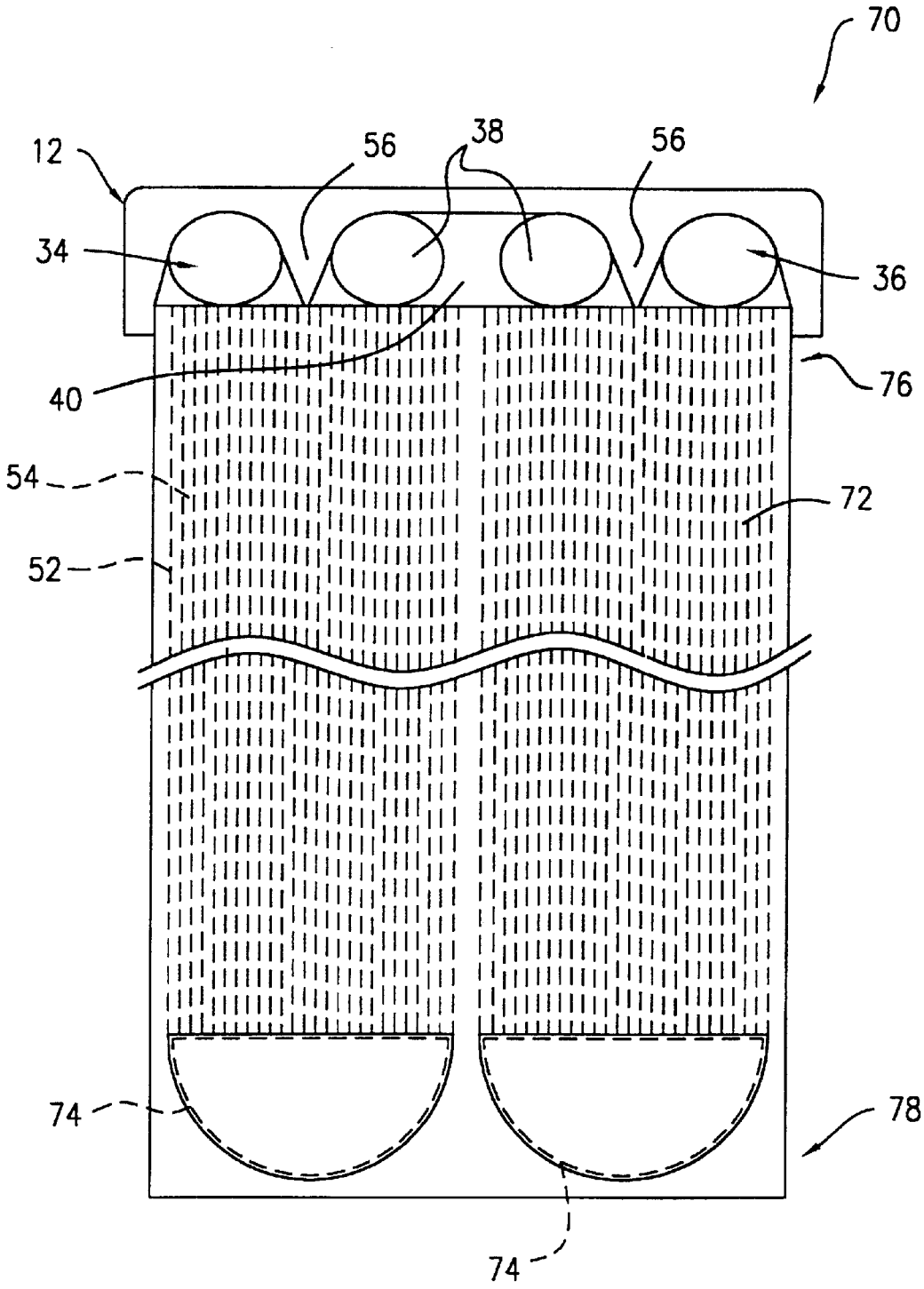
FIG. 6 is an elevational view of a plate and end-piece member component modified for a third embodiment of the present invention.

Referring to FIG. 6, a heat exchange assembly 70 is shown for a third embodiment of the present invention. The heat exchange assembly 70 includes the top fluid manifold 12 and a plate 72. The plate 72 is coupled to the top fluid manifold 12 in the same manner described above. The plate 72 includes the plurality of walls 52 defining the plurality of passages 54 which is open at one end 76 thereof, and two turning cavities 74 at the opposite end 78 thereof. In this configuration, the turning cavities 74 are built into the plate 72 and turn the fluid flow therein. It is noted that the plate 72 may be modified so that the turning cavities 74 are located at the end 76 thereof as disclosed in U.S. Pat. No. 5,638,900 incorporated herein by reference.

Figure 7:
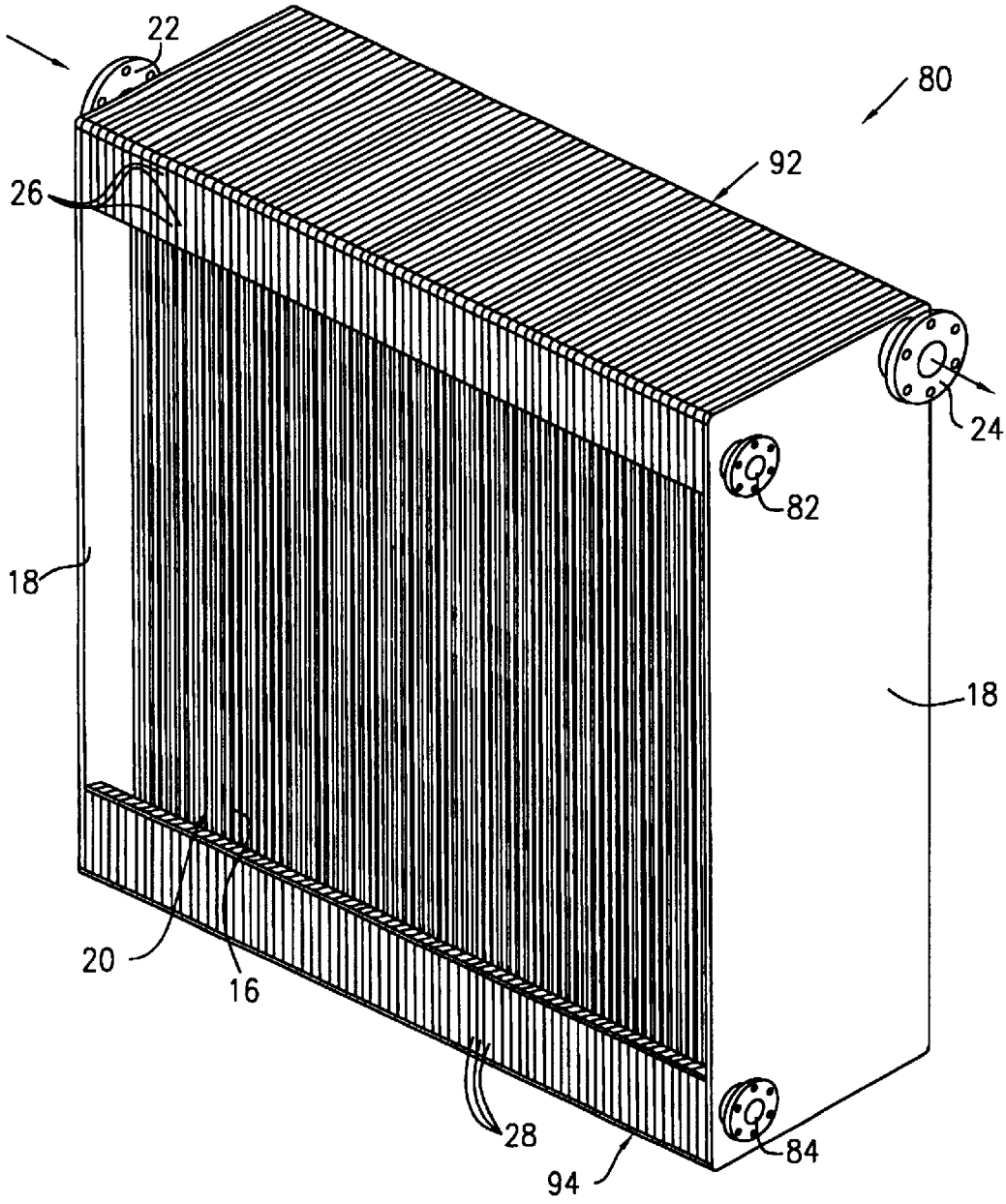
FIG. 7 is a perspective view of the heat exchange assembly for a fourth embodiment of the present invention.

Referring to FIG. 7, a heat exchange assembly 80 is shown for a fourth embodiment of the present invention. The heat exchange assembly is substantially similar to the heat exchange assembly 10 described above. In this embodiment, the heat exchange assembly 80 includes a top fluid manifold 92 and a bottom fluid manifold 94, which, in combination, incorporate a liquid desiccant distribution and collection system. The liquid desiccant distribution system is adapted to furnish a thin layer flow of a liquid desiccant over the surface of the plates 16 as will be described hereinafter. The heat exchange assembly 80 further includes a desiccant inlet fitting 82 and a desiccant outlet fitting 84 for supplying and discharging a liquid desiccant, respectively.

Figure 8:
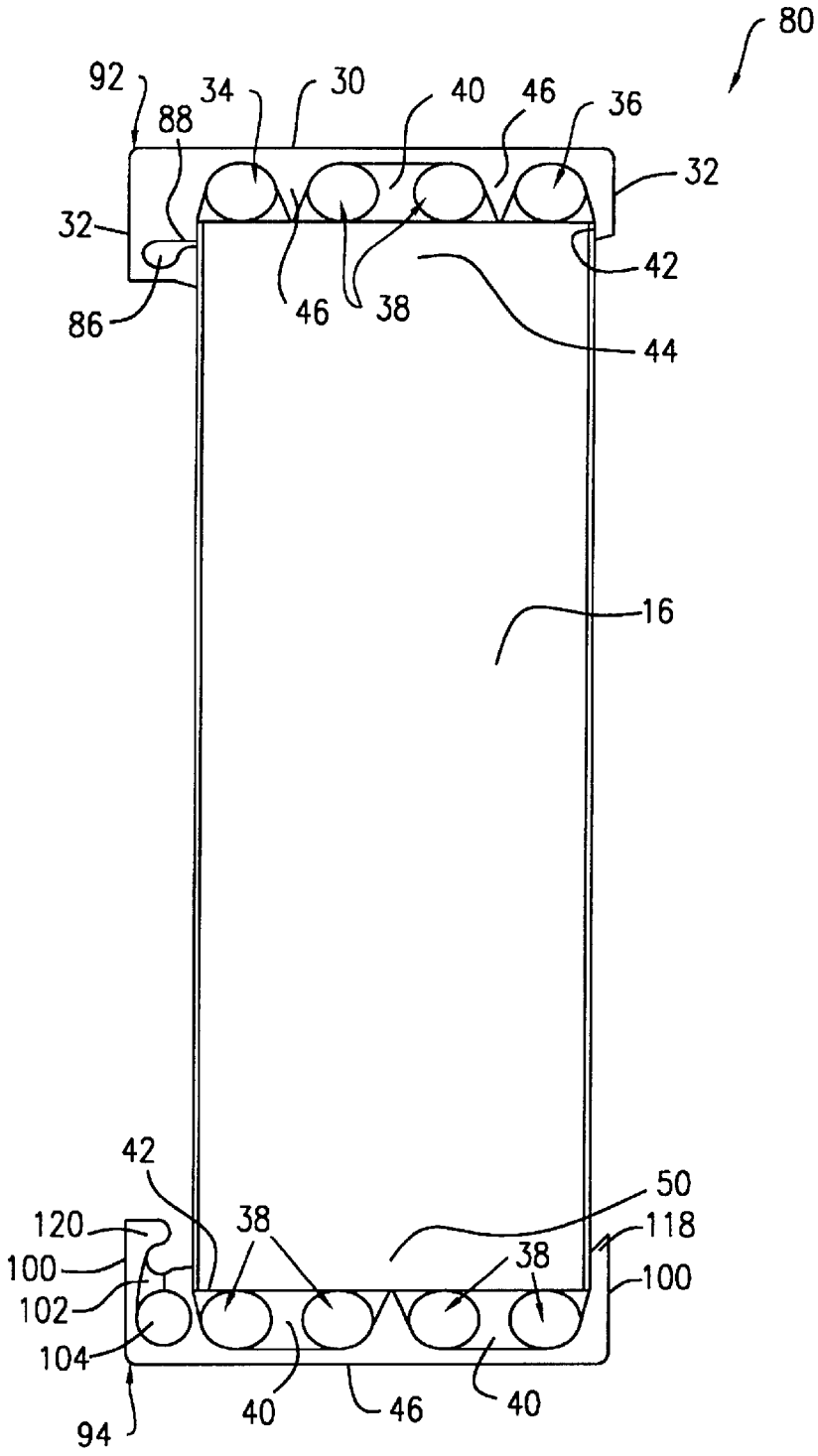
FIG. 8 is an elevational view of the heat exchange assembly of FIG. 7 with a top fluid manifold, a bottom fluid manifold and a plate mounted therebetween according to the present invention.

With reference to FIG. 8, the top fluid manifold 92 includes a liquid desiccant supply conduit 86 which extends along the length of the assembly 80 and is adapted for conveying the liquid desiccant from the inlet fitting 82 to the plates 16. The liquid desiccant supply conduit 86 branches into a plurality of supply lines 88 each of which carries the liquid desiccant to the spacing 20 between the adjacent plates 16. The liquid desiccant is then dispensed onto the surfaces of the adjacent plates 16 where it flows downwardly towards the bottom fluid manifold 94. The bottom fluid manifold 94 includes a side wall 100 which extends along each side of the bottom fluid manifold 94. The side walls 100 are adapted to hold the liquid desiccant flowing down the surface of the plates 16 and prevent the liquid desiccant from entraining into the external fluid medium passing through the spacings 20. The collected liquid desiccant flows toward one side of the manifold 94 where it passes through a drain 102 located between the plates 16 into a drain conduit 104. The drain conduit 104 extends along the length of the assembly 80. The liquid desiccant is eventually discharged through the desiccant outlet fitting 84 from the drain conduit 104. The discharged liquid desiccant is subsequently reprocessed or conveyed to a liquid desiccant regenerator (not shown).

Figure 9A:
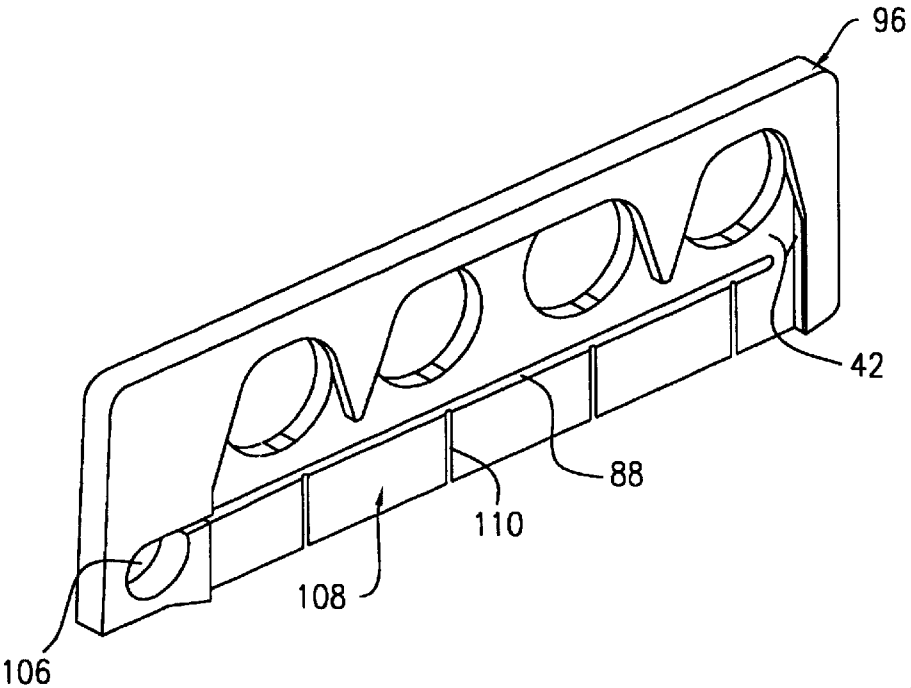
FIG. 9A is a perspective view of a top end-piece member of the heat exchanger assembly of FIG. 7 according to the present invention.

Referring to FIG. 9A, the top fluid manifold 92 is assembled from a plurality of top end-piece members 96 each of which is coupled to the end 44 of a plate 16. The top end-piece members 96 are affixed to adjacent ones to form the top fluid manifold 92. The top end-piece member 96 includes a supply throughhole 106 which forms a portion of the supply conduit 86, the supply line 88, and a distribution web 108 having multiple distribution grooves 110 disposed on both sides thereof extending from the supply line 88. Preferably, the distribution grooves 110 are disposed in a staggered arrangement relative between the grooves 110 on the front and back sides. The offsetting of the grooves 110 prevents the liquid desiccant from bridging the spacing 20 between the adjacent plates 16.

The top end-piece member 96 further includes the recessed region 42 adapted for receiving and securely retaining the end 44 of the plate 16. Upon affixing the plate 16 to the top end-piece member 96, the supply line 88 and the distribution grooves 110 are enclosed. The surface of the adjacent plate 16 on the other side of the top end-piece member 96 abuts thereagainst and encloses the supply line 88 and the distribution grooves 110 when the assembly 80 is constructed. During operation, the liquid desiccant flows from the conduit 86 into the supply line 88 and flows into the distribution grooves 110 where it is emptied onto the immediate surfaces of the adjacent plates 16. Optionally, a thin wick (not shown) may be applied to the exposed surfaces of the plate below the distribution grooves 110 for facilitating uniform distribution.

The distribution grooves 110 effectively feeds the liquid desiccant to the upper surface of the plate 16. The distribution grooves 110 may be adapted to feed approximately the same flow of liquid desiccant at each dispensing outlet. Since the fluid pressure of the liquid desiccant in the supply line 88 may vary along the length thereof, the distribution grooves would effectively maintain approximately equal flows only if the pressure drop is large compared to the pressure variations in the supply line 88.

For a given flow rate of liquid desiccant, the pressure drop in the distribution grooves 110 increases as the length of the groove 110 lengthens or the cross sectional diameter decreases. As the diameter of the groove 110 decreases, there is a greater likelihood that dirt, debris, or precipitates will block the groove 110. Alternatively, as the groove 110 lengthens, the distribution web 108 is likewise lengthened. This would undesirably increase the height of the corresponding heat exchange assembly. With reference to FIG. 9B, the pressure drop across the groove 110 may be increased by lengthening the grooves nonlinearly without lengthening the distribution web 108 as illustrated by grooves 110B, 110C, and 110D, respectively.

In the alternative, the liquid desiccant may be supplied by fabricating the distribution web 108 with a porous material such as open-cell plastic foam and the like. The liquid desiccant flows through the holes and saturates the material from the supply line 88. The liquid desiccant passes out from the bottom end of the porous material onto surface of the plates 16.

During operation of the heat exchange assembly, an air bubble may be present in the liquid desiccant within the supply line 88. The air bubble is eventually pushed through the distribution grooves 110 where it bursts and creates many small droplets of desiccant which may become undesirably entrained in the external fluid medium passing through the spacing 20. The entrained liquid desiccant is carried by the external fluid medium where it lands on an outside surface (e.g. air duct). Since most liquid desiccants are corrosive, the entrained liquid desiccants may cause serious maintenance problems.

Figure 9D:
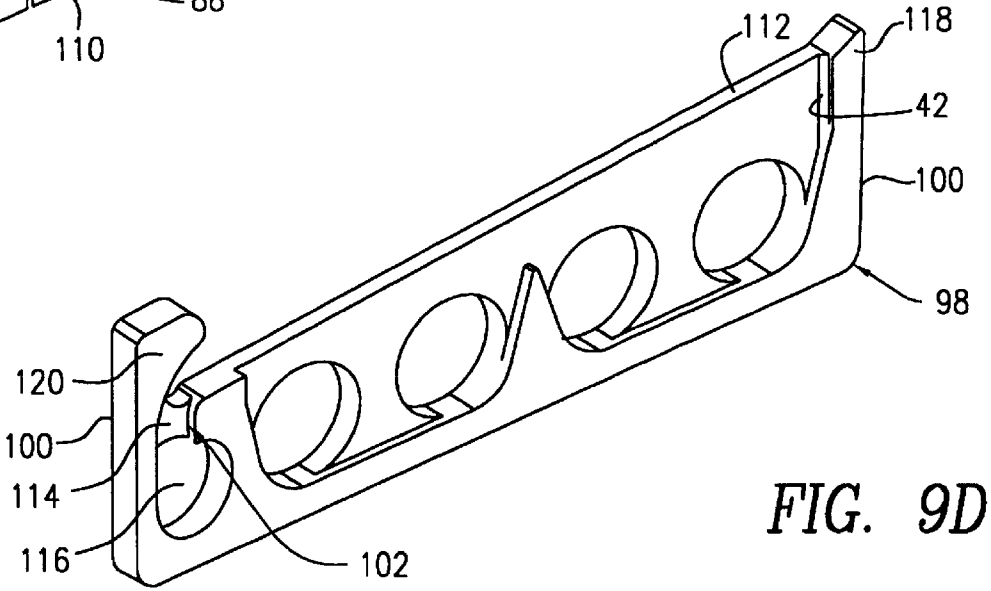
FIG. 9D is a perspective view of a bottom end-piece member of the heat exchanger assembly of FIG. 7 according to the present invention.
Figure 9B:
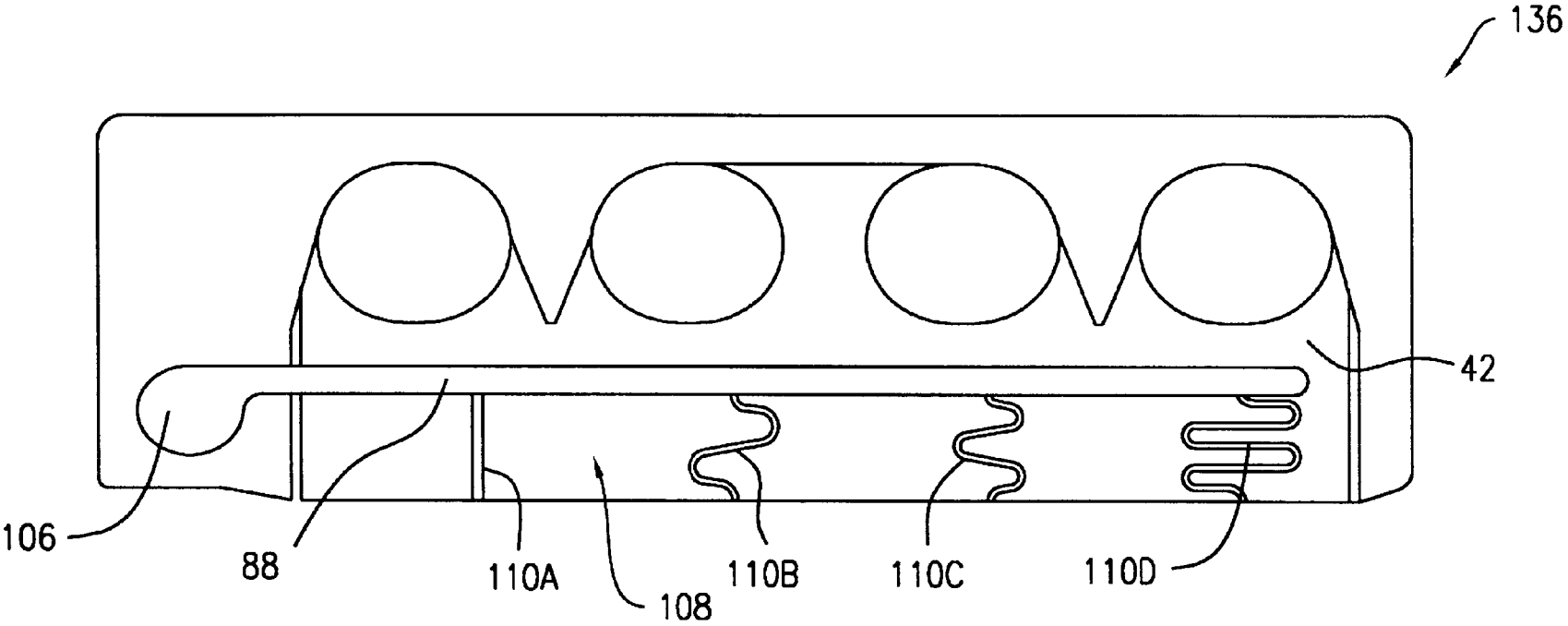
FIG. 9B is an elevational view of the top end-piece member having a desiccant supply web with exemplary forms of desiccant distribution grooves in the heat exchange assembly of FIG. 7 according to the present invention.
Figure 9C:
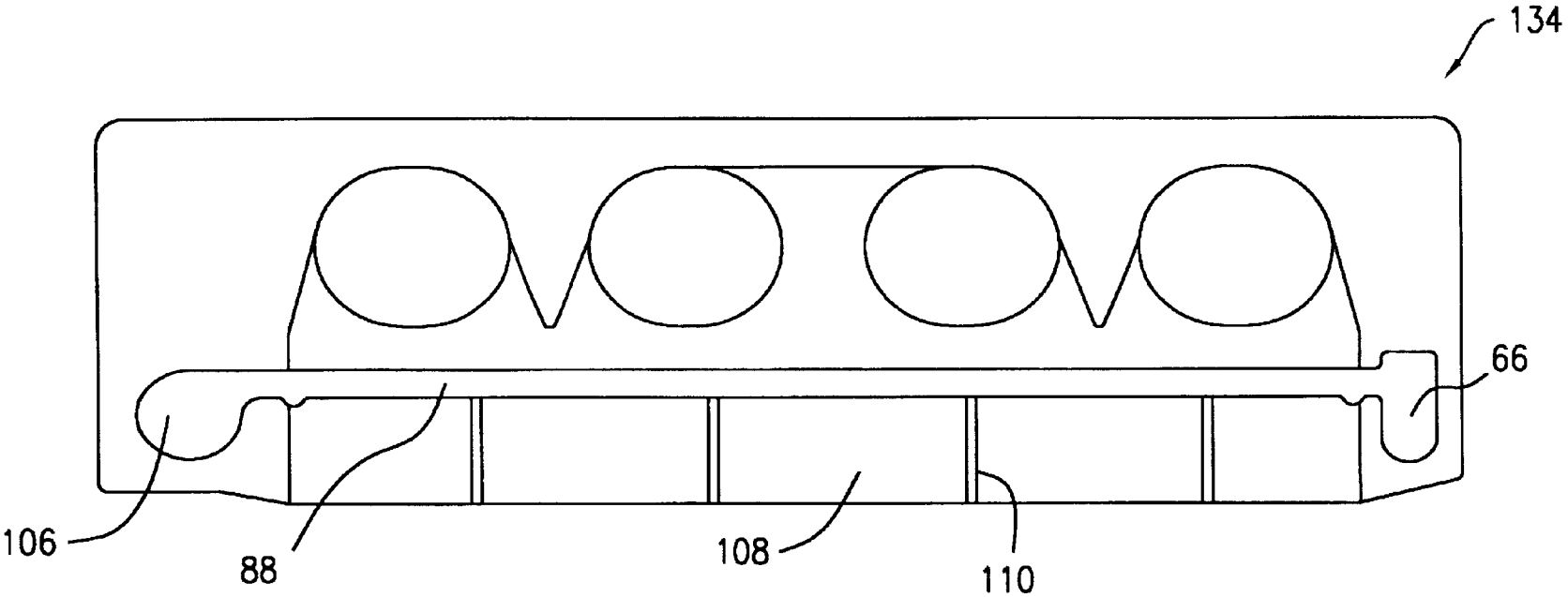
FIG. 9C is an elevational view of the top end-piece member incorporating a purge conduit for a fifth embodiment of the present invention.

With reference to FIG. 9C, a top end-piece member 134 includes a purge throughhole 66 to form a purge cavity (not shown) extending along the length of the constructed heat exchange assembly. The purge throughhole 66 is located at the opposite end from the desiccant supply throughhole 106 in communication with the supply line 88. In the heat exchange assembly utilizing the top end-piece member 134, the liquid desiccant flows into the distribution grooves 110 and into the purge cavity through the purge throughhole 66. Due to its lower density, the air bubbles present in the flow would travel along with the liquid desiccant in the supply line 106 and be carried straight into the purge cavity. The liquid desiccant and the air bubbles leaves the purge cavity through a corresponding purge fitting (not shown).

Referring to FIG. 9D, the bottom fluid manifold 94 is assembled from a plurality of bottom end-piece members 98 each of which is coupled to the end 50 of the plate 16 opposite from the top end-piece member 96. The end 50 of the plate 16 securely fits into the recessed region 42 and affixed thereto for secure retainment abutting against the tip of the barrier 56. A support web 114 is provided for imparting structural rigidity to the corresponding side wall 100. Preferably the thickness of the support web 114 is less than the total thickness of the bottom end-piece member 98, more preferably one half the thickness of the member 98 to form the drain 102. The bottom end-piece member 98 further includes a desiccant conduit throughhole 116 which forms a portion of the desiccant supply conduit 86 of the assembly 80. Optionally, the recessed region 42 may include a sloped edge portion 112 for funneling the liquid desiccant towards the drain 102. The sloped edge portion 112 is preferably inclined from about 5° to 15° from horizontal to facilitate the desiccant flow to the drain 102.

Optionally, the sidewall 100 proximate the higher end of the sloped edge portion 112 of the recessed region 42 may further include a leading-edge air dam 118 and the side wall proximate the lower end of the sloped edge portion 112 may further include a trailing edge-air dam 120. The leading and trailing edge-air dams 118 and 120, respectively, are adapted in combination to shield the liquid desiccant flowing along the sloped edge portion 112 from the external fluid medium passing between the spacings 20, thereby minimizing entrainment of the liquid desiccant in the external fluid medium flow. It is noted that the leading and trailing edge-air dams 118 and 120, respectively, and the sloped edge portion 112 are each optionally included and utilized for applications where the external fluid medium passes at a relatively high velocity.

Figure 10A:
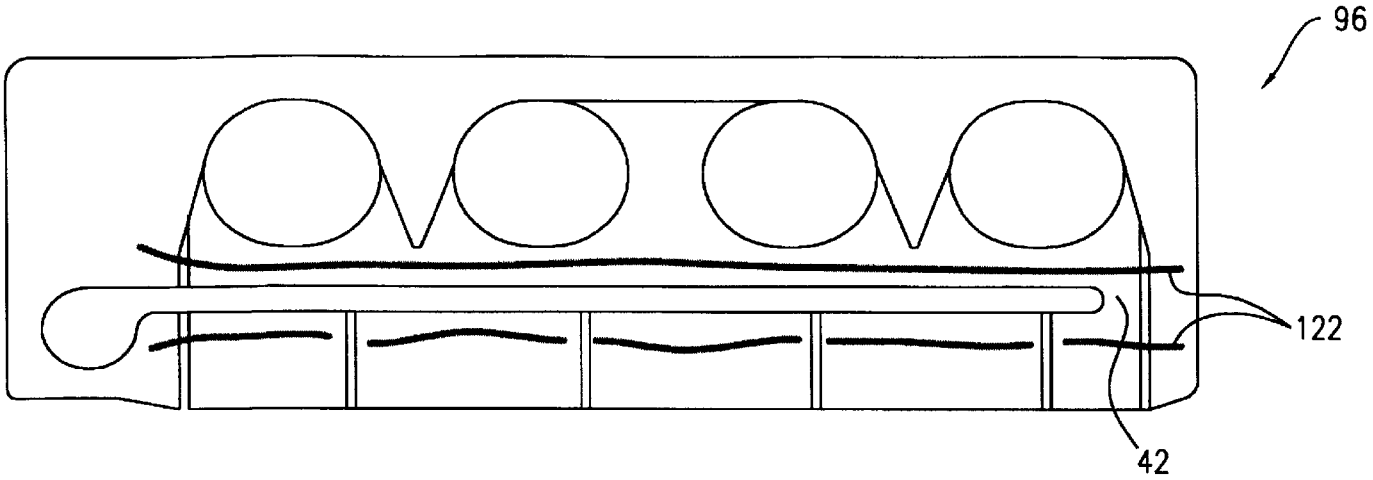
FIG. 10A is an elevational view of the top end-piece member showing an adhesive bead pattern for mounting onto the end of the plate in the heat exchange assembly of FIG. 7 according to the present invention.
Figure 10B:
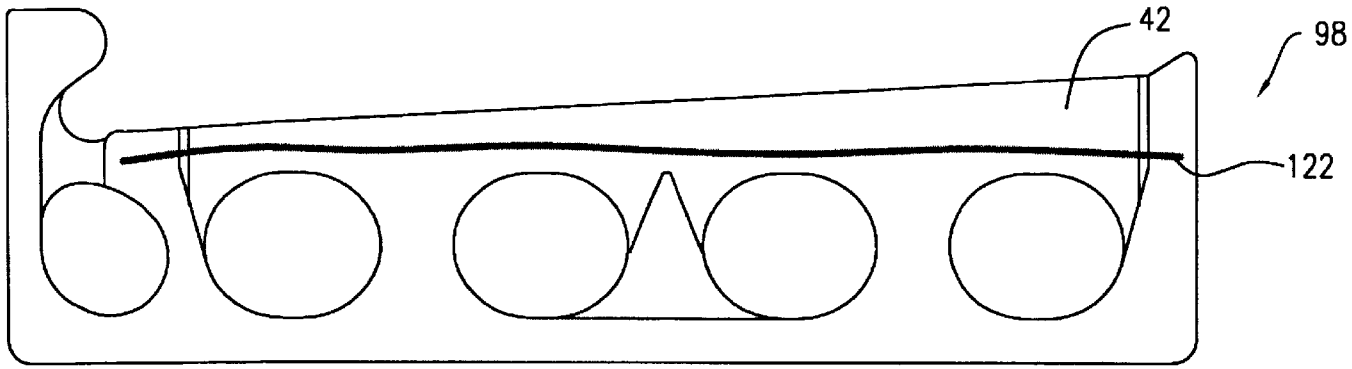
FIG. 10B is an elevational view of the bottom end-piece member showing an adhesive bead pattern for mounting onto the end of the plate in the heat exchange assembly of FIG. 7 according to the present invention.
Figure 11A:
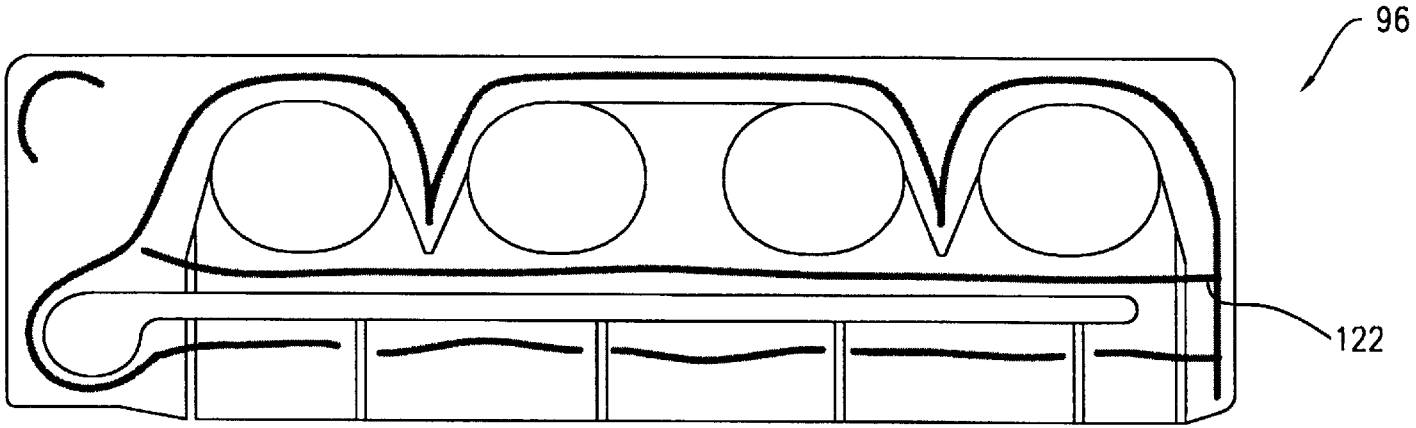
FIG. 11A is an elevational view of the top end-piece member showing an adhesive bead pattern for adjoining the adjacent top end-piece members in the heat exchange assembly of FIG. 7 according to the present invention.
Figure 11B:
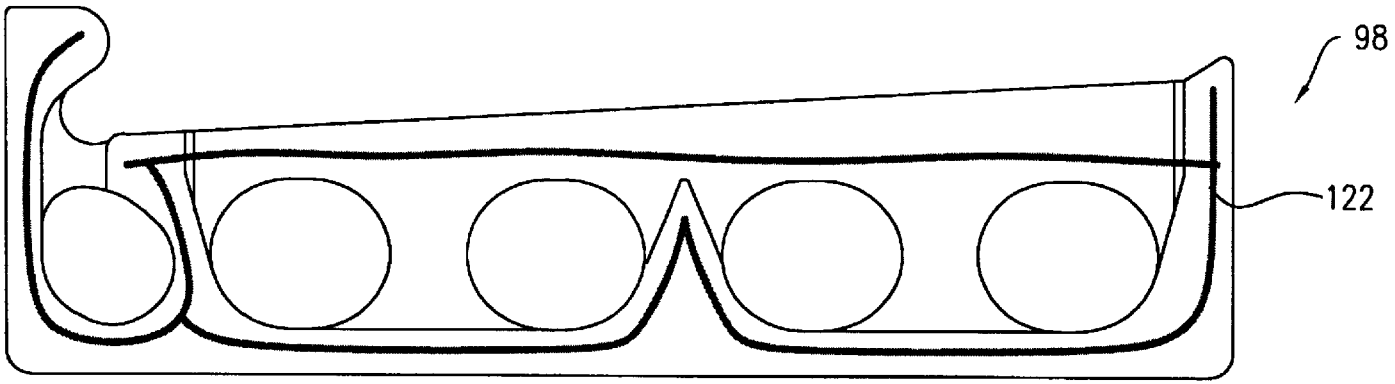
FIG. 11B is an elevational view of the bottom end-piece members showing an adhesive bead pattern for adjoining the adjacent bottom end-piece members in the heat exchange assembly of FIG. 7 according to the present invention.

The construction of the assembly 80 is carried out by coupling the top and bottom end-piece members 96 and 98, respectively, into the configuration shown in FIG. 8 to form a plate and end-piece member component in a similar manner described above for the assembly 10. The components are then affixed to one another in a stacked arrangement and affixed using methods including, but not limited to, gluing, fusing, bonding, brazing, welding, soldering, fastening and the like. Preferably, adhesives are used for bonding plastic component parts. The adhesive may be applied in the form of a bead to the face of the component parts for coupling. With reference to FIGS. 10A and 10B, an example of an adhesive bead 122 is shown applied to the recessed regions 42 of the end-piece members 96 and 98, respectively, for coupling with the ends 44 and 50, respectively, of a plate 16. With reference to FIGS. 11A and 11B, another example of an adhesive bead 122 is shown applied to the face of the end-piece members 96 and 98, respectively, for coupling with the plate 16 and the adjacent plate and end-piece member components in a stacked arrangement to construct the heat exchange assembly 80. Adjacent respective top and bottom end-piece members are joined together to maintain structural integrity of the assembly 80 and to form the corresponding top and bottom fluid manifolds and the corresponding fluid-tight passages and conduits adapted for the passage of the liquid desiccant and the internal heat transfer fluid therethrough.

Figure 12:
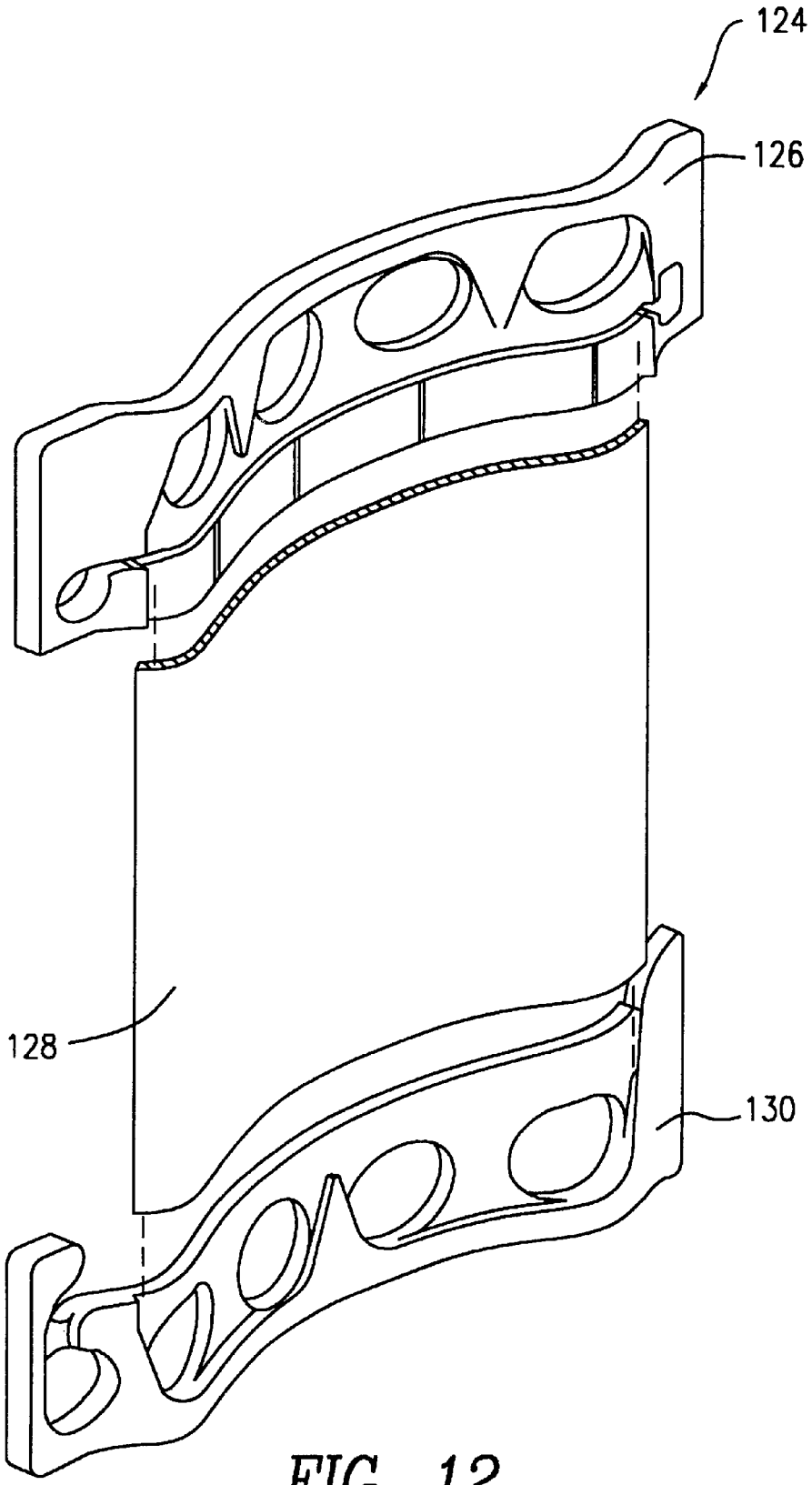
FIG. 12 is a perspective view of the plate and end-piece member component modified for a sixth embodiment of the present invention.

Referring to FIG. 12, a plate and end-piece member component 124 is shown for a sixth embodiment of the present invention. The component 124 includes a curved top end-piece member 126, a curved plate 128, and a curved bottom end-piece member 130. The curvature is formed in the direction perpendicular to the internal passages in the plate 128. The end-piece members 126 and 130 and the plate 128 are assembled in the same manner described above to construct a heat exchange assembly. In the assembled form, the components 124 improve the vertical compressive load capacity of the heat exchange assembly formed therefrom. This configuration may be utilized where space availability require multiple heat exchange assembly units to be placed in a stacked arrangement.

Figure 13:
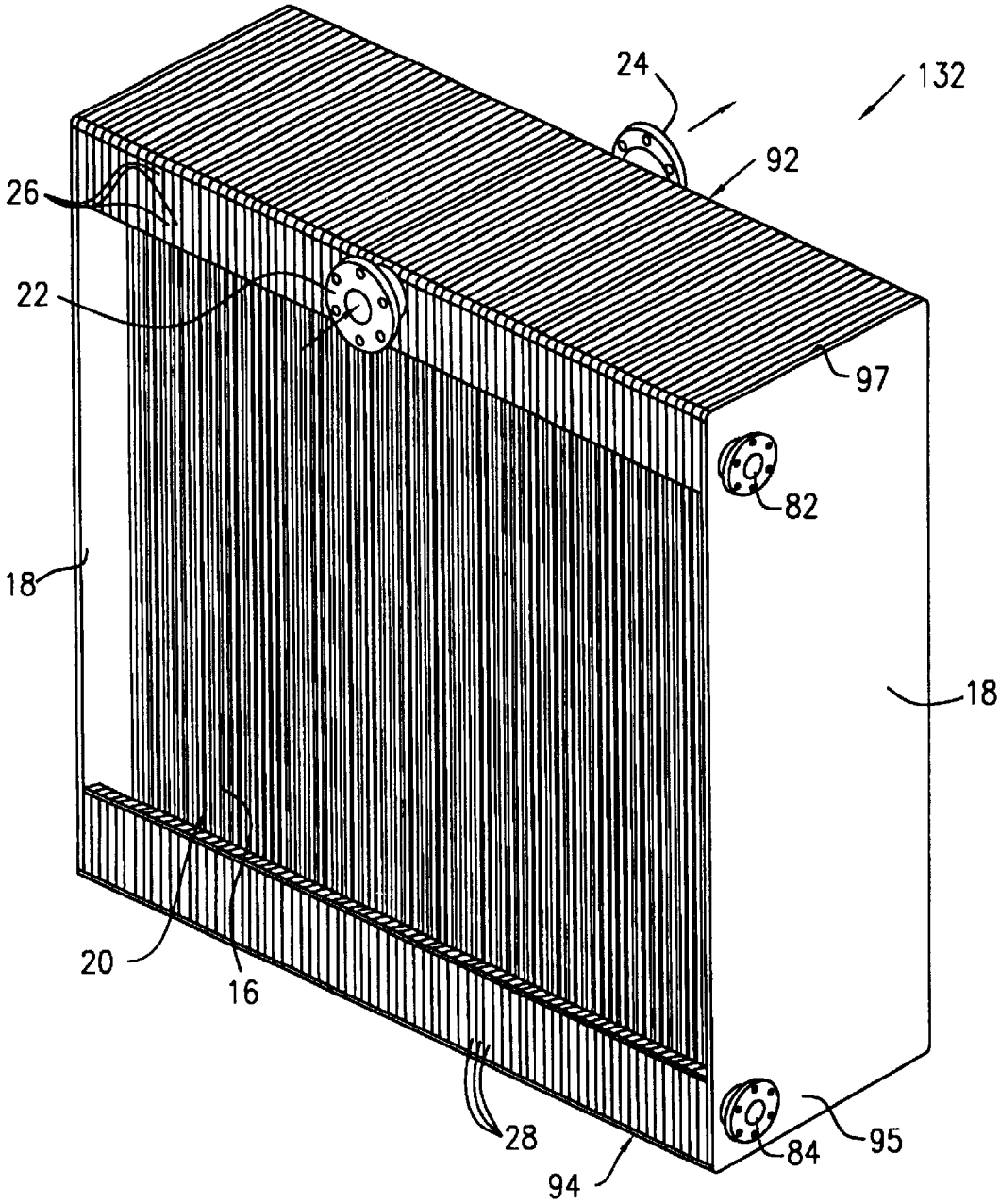
FIG. 13 is a perspective view of the heat exchange assembly modified for a seventh embodiment of the present invention.

Referring to FIG. 13, a heat exchange assembly 132 is shown for a seventh embodiment of the present invention. In this embodiment, the inlet and outlet fittings 22 and 24, respectively, are located at the front and rear side of the assembly 132. This illustrates an example that the corresponding fittings may be located on other portions of the heat exchange assembly of the present invention depending on the applications, installation requirements and the like. In the alternative, the bottom fluid manifold may include the inlet and outlet conduits for receiving and discharging the internal heat transfer fluid in the heat exchange assembly. It is noted that the inlet and outlet fittings 22 and 24, respectively, may be also located on top and bottom portions 95 and 97 of the manifolds 92 and 94, respectively.

Under some conditions when the device of the present invention is performing a heat exchange function, condensation may develop on the outer surface of the plates and travel down the plates to the bottom of the assembly. Under these circumstances it may be advantageous to provide a collection vessel for the condensation or any liquid which may form or be present on the outside surface of the plates.

Figure 14:
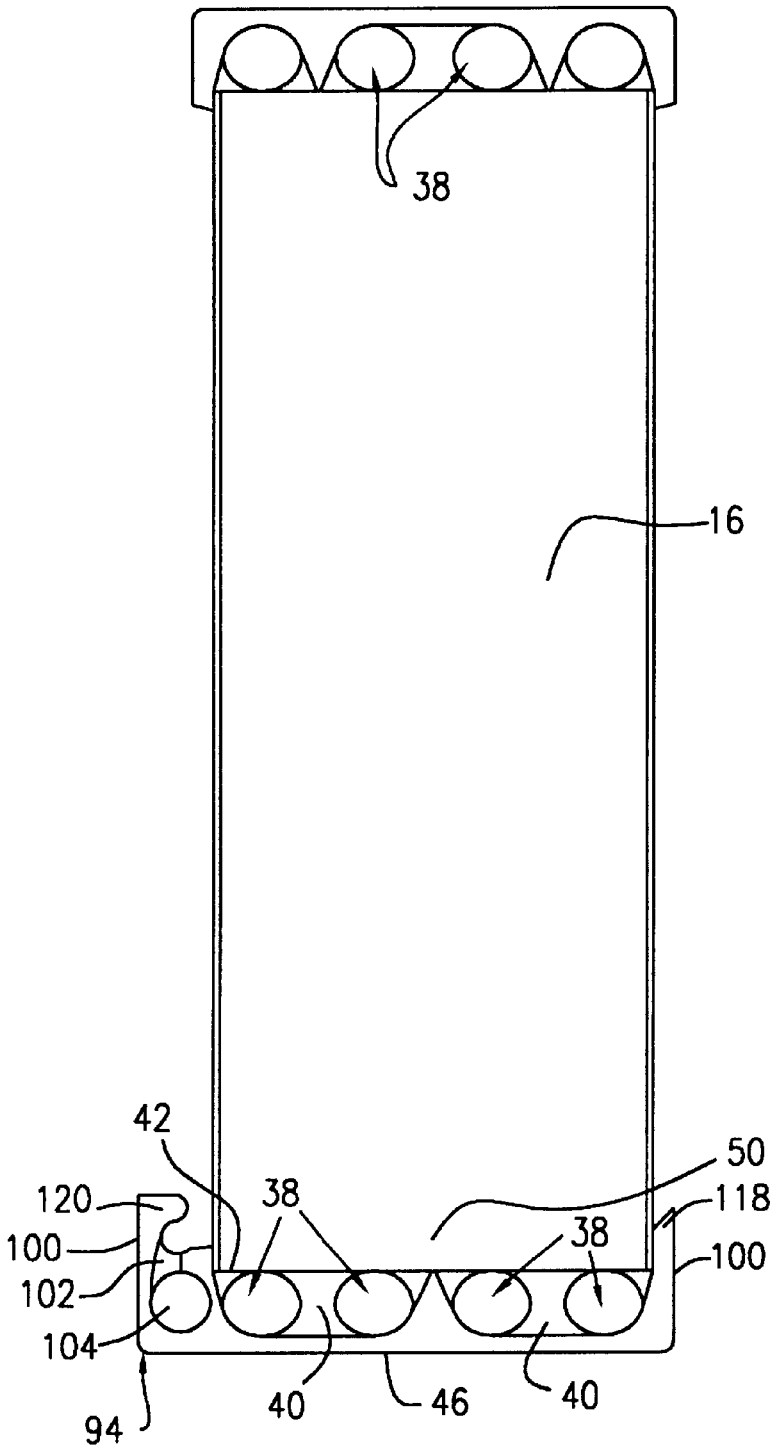
FIG. 14 is an elevational view of a top and bottom end-piece member modified for another embodiment of the present invention.

With reference to FIG. 14, the bottom fluid manifold 94 includes a side wall 100. The side walls 100 are adapted to hold the liquid (e.g. condensate) flowing down the surface of the plates 16 and prevent the liquid from entraining into the external fluid medium passing through the spacings 20. The collected liquid flows toward one side of the manifold 94 where it passes through a drain 102 located between the plates 16 into a drain conduit 104. The drain conduit 104 extends along the length of the assembly 80. The liquid is eventually discharged through the outlet fitting 84 from the drain conduit 104.

The foregoing discussion discloses and describes merely exemplary embodiments of the present invention. One skilled in the art will readily recognize from such discussion, and from the accompanying drawings, claims and example, that various changes, modifications and variations can be made therein without departing from the spirit and scope of the invention as defined in the following claims.

EXAMPLE 1

A heat exchange assembly of the type shown in FIG. 7 was built and tested. The assembly was constructed from a plurality of flat, rectilinear plates made of polyvinyl extrusion and top and bottom end-piece members made of polyvinyl chloride. Each plate had a thickness of about 0.1 of an inch, a width of about 13 inches and a length of about 27 inches. The diameter of the passages extending through the plates was about 0.08 of an inch in diameter. Each end-piece member was about 0.23 of an inch thick, and 15.5 inches wide. The configuration of the end-pieces were similar to those shown in FIGS. 9A and 9D. A polymethyl methacrylate adhesive was used to bond the end-piece members and the plates. The exposed surface of the plates were flocked with acrylic fibers to form a porous surface. The acrylic fibers were 15 mil in length. In this test, the assembly was constructed with fourteen plates.

The assembly was tested under the following conditions listed below.

| | |
|---|---|
| Inlet air temperature | 86° F. |
| Inlet air humidity | 0.0231 lb water per lb dry air |
| Inlet air velocity | 640 fpm |
| Coolant inlet temperature | 75° F. |
| Coolant flow rate | 3 gpm |
| Desiccant inlet concentration | 42% lithium chloride in water |
| Desiccant flow rate | 250 ml/minute |

The results of the test were determined as follows.

| | |
|---|---|
| Outlet air temperature | 86° F. |
| Outlet air humidity | 0.0114 lb water per lb dry air |

What is claimed is:

1. A heat exchange assembly comprising:

a plurality of plates disposed in a spaced-apart arrangement, each of said plurality of plates includes a plurality of passages extending internally from a first end to a second end for directing flow of a heat transfer fluid in a first plane;

a plurality of first end-piece members equaling the number of plates and a plurality of second end-piece members also equaling the number of plates, each of said first and second end-piece members including a recessed region adapted to fluidly connect and couple with the first and second ends of said plate, respectively, and further adapted to be affixed to respective adjacent first and second end-piece members in a stacked formation, wherein the depth of the recessed region is greater than the thickness of the plate, and the opposed surface from the recessed region of the corresponding first and second end-piece members includes a raised portion adapted for fitting into the recessed region of an adjacent end-piece member in conjunction with the end portion of the adjacent plate, and each of said first and second end-piece members further including at least one cavity for enabling entry of said heat transfer fluid into the plate, exit of said heat transfer fluid from said plate, or 180° turning of said fluid within the plate to create a fluid flow path between points of entry and exit of said fluid; and at least two fluid conduits extending through the stacked plurality of first and second end-piece members for providing first fluid connections between the parallel fluid entry points of adjacent plates and a fluid supply inlet, and second fluid connections between the parallel fluid exit points of adjacent plates and a fluid discharge outlet so that the heat transfer fluid travels in parallel paths through each respective plate.

2. The heat exchange assembly of claim 1 wherein adjacent turning cavities longitudinally aligned within the stacked plurality of first and second end-piece members are fluidly connected therebetween by a fluid bypass conduit.

3. The heat exchange assembly of claim 1 wherein the fluid supply inlet and fluid discharge outlet are present on areas of the stacked plurality of first and second end-piece members including at least on front and back portions, end portions, top and bottom portions, or combinations thereof.

* * * * *